United States Patent [19]

Gebhardt et al.

[11] 4,231,299

[45] Nov. 4, 1980

[54] MERCHANDISING DISPLAY

[75] Inventors: James L. Gebhardt, Roswell; Ferris L. Hutchins, Jr., Doraville, both of Ga.

[73] Assignee: The Mead Corporation, Dayton, Ohio

[21] Appl. No.: 49,189

[22] Filed: Jun. 15, 1979

[51] Int. Cl.[3] ..... A47B 7/00

[52] U.S. Cl. ..... 108/91; D6/186; 108/111; 312/259

[58] Field of Search ..... D6/186; 403/363, 231, 403/110, 397, 405; 312/259, 261; 248/174; 206/591, 594; 52/137; 108/91, 111

[56] References Cited

U.S. PATENT DOCUMENTS

| | | | |
|---|---|---|---|
| 2,748,954 | 6/1956 | Murren | 108/111 X |
| 2,938,743 | 5/1960 | Sproule | 403/363 X |
| 2,944,780 | 7/1960 | Monk | 108/111 X |
| 3,708,101 | 1/1973 | McDanield | 206/591 X |
| 3,834,324 | 9/1974 | Lang | 108/91 |
| 4,119,045 | 10/1978 | Michelotti | 108/156 |
| 4,128,222 | 12/1978 | Wiczer | 108/156 |

FOREIGN PATENT DOCUMENTS

| | | | |
|---|---|---|---|
| 1017565 | 10/1957 | Fed. Rep. of Germany | 403/363 |

*Primary Examiner*—James T. McCall

*Attorney, Agent, or Firm*—Rodgers & Rodgers

[57] ABSTRACT

A merchandising display comprising a top, a pair of side panels foldably joined respectively to the sides of the top and extending downwardly therefrom, a pair of end panels foldably joined respectively to the ends of the top and extending downwardly therefrom, a pair of V-shaped support elements disposed at each corner of the display and extending downwardly therefrom, a retention clip disposed in a locking relationship with each pair of V-shaped support elements, and a support tube joined to the side panels and disposed adjacent the underside of the top.

9 Claims, 3 Drawing Figures

MERCHANDISING DISPLAY

TECHNICAL FIELD

This invention relates to merchandising displays which are economical to produce, easy to assemble, and highly maneuverable.

BACKGROUND ART

Merchandising displays which are utilized in temporary promotions especially at the retail level are generally known and are embodied in various forms. An example of this type of display is disclosed and claimed in U.S. patent application Ser. No. 957,296 filed Nov. 2, 1978 and owned by the assignee of this invention.

DISCLOSURE OF INVENTION

According to this invention a merchandising display comprises a top with legs joined at each corner thereof and extending downwardly therefrom, each leg comprising a pair of elongated V-shaped support elements, and an elongated retention clip interlocking each pair of V-shaped support elements.

BEST MODE FOR CARRYING OUT THE INVENTION

Figure 1:
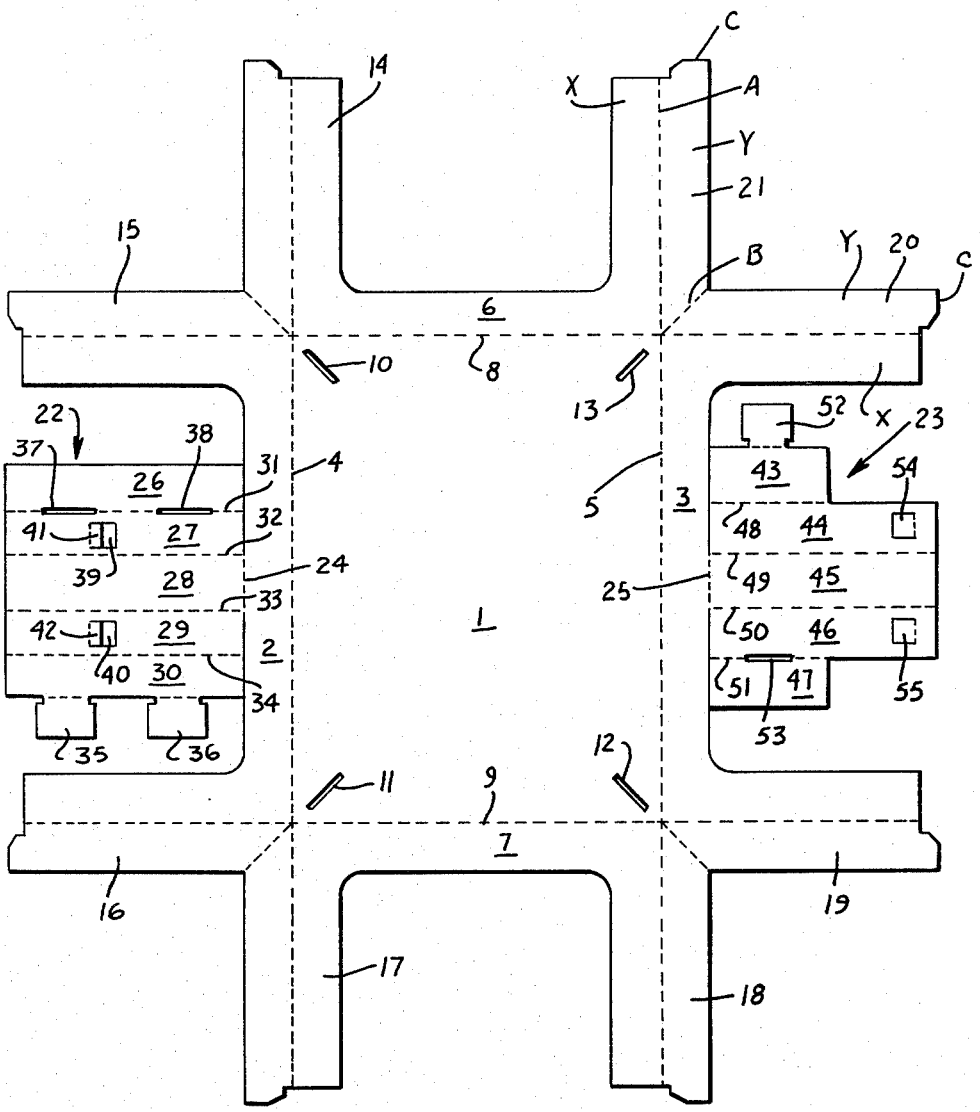
FIG. 1 is a plan view of a blank from which a merchandising display is formed according to this invention.

In the drawings the numeral 1 designates the top of the display to the side edges of which side panels 2 and 3 are foldably joined respectively along fold lines 4 and 5. In addition end panels 6 and 7 are foldably joined respectively to the end edges of top 1 along fold lines 8 and 9. Slots 10, 11, 12 and 13 are formed in top 1 at the corners thereof.

According to a feature of this invention, the display legs are formed from V-shaped support elements identified by the numerals 14–21 and which are integrally joined to the respective side or end panel as shown in FIG. 1. The apex of each V-shaped support element is formed along fold line A and each pair of V-shaped support elements is foldably joined along fold line B. Also stabilizing tab C is formed on the lower edge of one of each pair of the V-shaped support elements 14–21.

In order to prevent sagging of top 1 in the completed display, a support tube is provided and is formed from support tube elements indicated generally by the numerals 22 and 23. Support tube element 22 is foldably joined to the lower edge of side panel 2 along fold line 24 and support tube element 23 and foldably joined to the lower edge of side panel 3 along fold line 25.

Support tube element 22 is provided with supporting walls 26, 27, 28, 29 and 30 and intermediate fold lines 31, 32, 33, and 34. Locking means is provided in the form of locking tabs 35 and 36 which are adapted to cooperate with slots 37 and 38 respectively. In addition apertures 39 and 40 are formed respectively in supporting walls 27 and 29 and are provided respectively with retaining tabs 41 and 42.

Support tube element 23 is constructed in a manner similar to support tube element 22 and is provided with supporting walls 43, 44, 45, 46 and 47 which are interconnected by means of fold lines 48, 49, 50 and 51. Also locking tab 52 is adapted to cooperate with slot 53 and locking tabs 54 and 55 are formed respectively in supporting walls 44 and 46.

Figure 2:
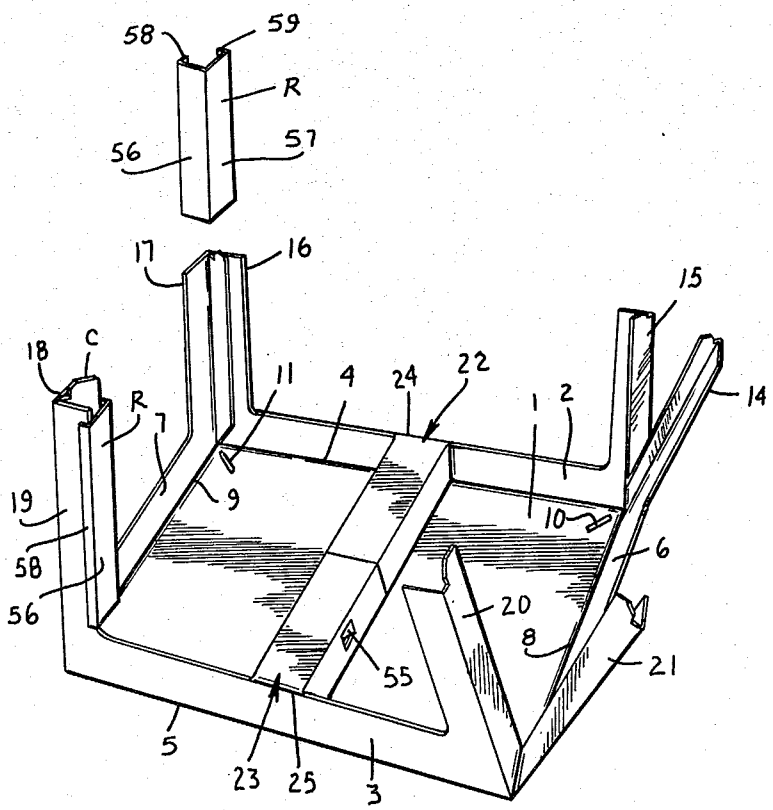
FIG. 2 is an isometric view from the bottom depicting assembly of the display.

In order to form the display from the blank shown in FIG. 1, initially it is necessary to fold side panels 2 and 3 and end panels 6 and 7 together with V-shaped support elements 14–21 upwardly along fold lines 4, 5, 8 and 9 . As this occurs, each pair of V-shaped support elements is folded inwardly along fold line B and the individual panels X and Y of each V-shaped support element are folded into a 45° angle along fold line A as best shown in FIG. 2.

In order to interlock each pair of V-shaped support elements formed at the corners of the display, retention clip R is provided. More specifically retention clip R is provided with base strips 56 and 57 which are integrally joined along the adjacent edges thereof. In addition locking strips 58 and 59 are integrally joined to the outer edges of base strips 56 and 57 respectively and extend inwardly therefrom. Therefore to complete formation of the display legs, retention clip R is simply slipped over each pair of V-shaped support elements. In this manner, locking strips 58 and 59 are manipulated into an overlapping and enveloping relationship with the respective outer edge portions of panels X of each V-shaped support element which are disposed remote from line A.

In order to provide additional support on the underside of top 1 and thereby to prevent any sagging thereof, a support tube formed from support tube elements 22 and 23 is provided. Specifically supporting walls 26–30 of support tube element 22 are folded along fold lines 31–34 into a square configuration in cross section and locking tabs 35 and 36 are inserted into slots 37 and 38 respectively. Support tube 22 is then rotated upwardly about fold line 24 into a position whereby supporting wall 30 is disposed in face contacting relation with the underside of top 1.

Thereafter support tube element 23 is formed in a manner similar to support tube element 22. Specifically supporting walls 43–47 are folded along fold lines 48–51into a square cross sectional configuration and locking tab 52 is inserted into slot 53. Since supporting walls 43 and 47 are shorter than supporting walls 44, 45 and 46, support tube element 23 is simply slipped over support tube element 22 whereby the inner portions of supporting walls 44, 45 and 46 are disposed in flat face contacting relation with the inner portions of supporting walls 27, 28 and 29 respectively and as best shown in FIG. 2. Thereafter locking tabs 54 and 55 are manually punched through apertures 39 annd 40 respectively and held there in place respectively by means of retaining tabs 41 and 42.

An alternative means for providing a display support tube is to eliminate support tube elements 22 and 23 and to form a pair of round holes in side panels 2 and 3 respectively. Then a rigid circular tube is inserted through the holes into a position of abutment with the underside of top 1.

Figure 3:
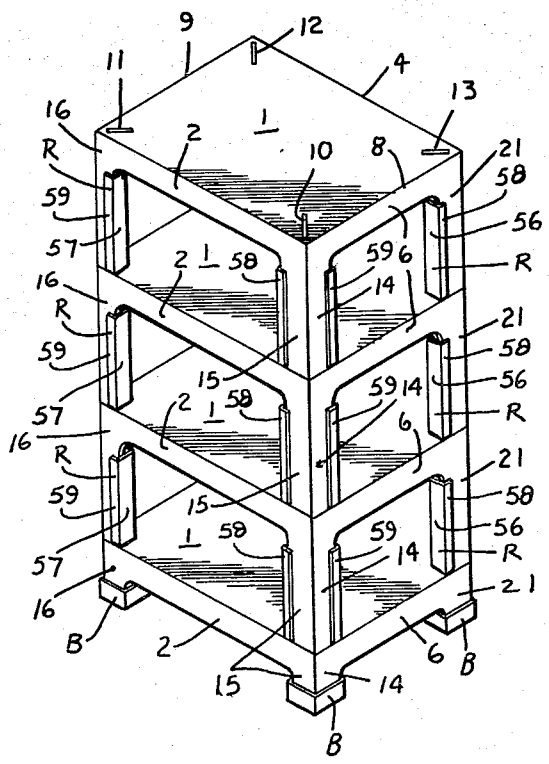
FIG. 3 shows multiple merchandising displays disposed in a stacked relationship.

In order to form a multiple display as shown in FIG. 3, a base display is formed by initially shortening the V-shaped support elements 14–21 shown in FIG. 1 to any desired length. Thereafter a base cup B is inserted onto the lower portion of each shortened display leg in a conventional manner. Then any number of displays, formed according to this invention, are stacked one upon the other. In order to maintain the overall display in a sturdy condition, stabilizing tabs C of one display are simply inserted into the respective slots 10–13 formed in the display disposed immediately therebelow. The merchandising display then appears as shown in FIG. 3.

INDUSTRIAL APPLICABILITY

By this invention a merchandising display is provided which is economical to produce and very easy to assemble. Therefore the display can be adapted to a variety of retail applications and is especially well suited to instances where the display must support a large amount of weight.

We claim:

1. A merchandising display comprising a top with legs disposed respectively at each corner thereof and extending downwardly therefrom, and characterized in that each of said legs comprises a pair of elongated V-shaped support elements arranged with the apexes of said V-shaped support elements of each pair in close juxtaposition and an elongated retention clip arranged to envelope and interlock each pair of said V-shaped support elements.

2. A merchandising display according to claim 1 and further characterized in that a slot is formed in said top adjacent one corner thereof.

3. A merchandising display according to claim 2 and further characterized in that a stabilizing tab is formed on the lower edge of one of said legs and adapted to cooperate with said slot of an adjacent display disposed therebelow.

4. A merchandising display according to claim 1 and further characterized in that a pair of side panels are foldably joined respectively to the side edges of said top and a pair of end panels are foldably joined respectively to the end edges of said top.

5. A merchandising display according to claim 4 and further characterized in that a support tube is secured to one of said pairs of panels and disposed in an abutting relationship with the underside of said top.

6. A merchandising display according to claim 4 and further characterized in that each of said V-shaped support elements is integrally joined to the end of the adjacent one of said panels.

7. A merchandising display according to claim 1 and further characterized in that said retention clip comprises a pair of base strips integrally joined along adjacent edges and a pair of locking strips integrally joined respectively to said base strips along the edges thereof remote from said adjacent edges and extending inwardly therefrom.

8. A merchandising display according to claim 7 and further characterized in that said locking strips are disposed respectively in overlapping relation with the outer portions of each said V-shaped support elements.

9. A merchandising display according to claim 8 and further characterized in that the inner adjacent edges of each pair of V-shaped support elements are disposed in abutting relationship with said adjacent edges of the associated pair of said base strips.

* * * * *